US010170237B2

(12) United States Patent
Ginglseder et al.

(10) Patent No.: US 10,170,237 B2
(45) Date of Patent: Jan. 1, 2019

(54) PLATE-SHAPED LEAKAGE STRUCTURE AS AN INSERT IN A MAGNETIC CORE

(71) Applicant: SUMIDA Components & Modules GmbH, Obernzell (DE)

(72) Inventors: Norbert Ginglseder, Furstenzell (DE); Martin Grubl, Untergriesbach (DE)

(73) Assignee: SUMIDA Components & Modules GmbH, Obernzell (DE)

( * ) Notice: Subject to any disclaimer, the term of this patent is extended or adjusted under 35 U.S.C. 154(b) by 692 days.

(21) Appl. No.: 14/664,834

(22) Filed: Mar. 21, 2015

(65) Prior Publication Data

US 2015/0279552 A1 Oct. 1, 2015

(30) Foreign Application Priority Data

Mar. 26, 2014 (DE) ..... 10 2014 205 560

(51) Int. Cl.
*H01F 27/24* (2006.01)
*H01F 17/06* (2006.01)
(Continued)

(52) U.S. Cl.
CPC ..... *H01F 27/38* (2013.01); *H01F 3/12* (2013.01); *H01F 3/14* (2013.01); *H01F 17/043* (2013.01);
(Continued)

(58) Field of Classification Search
CPC . H01F 3/12; H01F 3/14; H01F 17/043; H01F 27/255; H01F 27/24;
(Continued)

(56) References Cited

U.S. PATENT DOCUMENTS 4,047,138 A 9/1977 Steigerwald ..... 336/100
4,257,025 A * 3/1981 Hareland ..... H01F 27/346 336/178
(Continued)

FOREIGN PATENT DOCUMENTS

CN 103236339 8/2013
DE 3821284 A1 12/1989
(Continued)

OTHER PUBLICATIONS

Office Action dated Jul. 13, 2016 in corresponding Japanese Application No. 2015-062589.
(Continued)

*Primary Examiner* — Mangtin Lian
(74) *Attorney, Agent, or Firm* — Fattibene and Fattibene LLC; Paul A. Fattibene

(57) ABSTRACT

In various aspects, a plate-shaped leakage structure as an insert in a magnetic core of an inductive component, a magnetic core having a plate-shaped leakage structure, and an inductive component. In illustrative embodiments, a plate-shaped leakage structure is provided as an insert in a magnetic core, which is passed through, along the thickness direction thereof, by at least one spacer having a very low magnetic permeability (as opposed to the rest of the material of the leakage structure). In a magnetic core according to an aspect, core legs are arranged above opposite bearing surfaces of the plate-shaped leakage structure, the plate-shaped leakage structure providing a leakage path between the core legs.

3 Claims, 2 Drawing Sheets

(51) Int. Cl.

| | |
|---|---|
| ***H01F 27/38*** | (2006.01) |
| ***H01F 3/12*** | (2006.01) |
| ***H01F 3/14*** | (2006.01) |
| ***H01F 17/04*** | (2006.01) |
| ***H01F 27/255*** | (2006.01) |
| ***H01F 27/28*** | (2006.01) |

(52) U.S. Cl.
CPC ..... *H01F 27/24* (2013.01); *H01F 27/255* (2013.01); *H01F 27/2823* (2013.01)

(58) Field of Classification Search
CPC ..... H01F 27/2823; H01F 27/38; H01F 38/08; H01F 27/34; H01F 27/346
USPC ..... 336/178, 212, 220, 233, 155, 160, 165
See application file for complete search history.

(56) References Cited

U.S. PATENT DOCUMENTS

| | | | | |
|---|---|---|---|---|
| 5,626,983 | A | 8/1997 | Ito et al. | 335/297 |
| 6,885,273 | B2 * | 4/2005 | Min | H01F 3/14 336/178 |
| 2010/0171580 | A1 | 7/2010 | Abe et al. | 336/178 |
| 2011/0309905 | A1 * | 12/2011 | Anger | H01F 3/14 336/212 |
| 2012/0188048 | A1 * | 7/2012 | Hughes | H01F 27/263 336/212 |
| 2014/0191839 | A1 * | 7/2014 | Sato | H01F 1/24 336/221 |

FOREIGN PATENT DOCUMENTS

| | | |
|---|---|---|
| DE | 202011051056 | 1/2012 |
| FR | 2 223 800 | 10/1974 |
| JP | S55-110017 | 8/1980 |
| JP | S59-61110 | 4/1984 |
| JP | S 5961021 | 4/1984 |
| JP | H06-151190 | 5/1994 |
| JP | H06-237393 | 8/1994 |
| JP | 2006310811 | 11/2006 |
| JP | 2011-146605 A | 7/2011 |

OTHER PUBLICATIONS

Office Action dated Jul. 13, 2016 in corresponding Chinese Application No. 201510138239X.
German search report dated Jun. 30, 2014 in corresponding German Application No. 10 2014 205 560.1.
Office Action dated Feb. 9, 2016 in corresponding Japanese Application No. 2015-062589 and English translation.

* cited by examiner

PLATE-SHAPED LEAKAGE STRUCTURE AS AN INSERT IN A MAGNETIC CORE

BACKGROUND OF THE INVENTION

1. Field of the Invention

The present invention relates to a plate-shaped leakage structure as an insert in a magnetic core of an inductive component, to a magnetic core having a plate-shaped leakage structure, and to an inductive component. The present invention particularly relates to chokes and transformers with a plate-shaped leakage structure inserted into same, for a facilitated adaptation of leakage path guidances, and for obtaining high, adjustable leakage inductance values.

2. Description of the Related Art

Inductive components are configured as chokes and transformers having magnetic cores. In general, a magnetic core of an inductive component is made of a ferromagnetic material, e.g. iron powder or ferrite, and serves to guide the magnetic field, while the magnetic coupling between the windings, and turns of individual windings, is improved at the same time. The winding is, in this case, formed of a conductive material, e.g. copper or aluminum, and has the shape of a flat wire, a round wire, a braided wire or a film wire.

A smoothing choke represents a specific example for an inductive component, which is used for the reduction of the residual ripple of a direct current with a superimposed ripple current. Smoothing chokes are used, for example, for voltage converters, or generally for components in which current fluctuations are not desired.

However, in various cases of application a limitation of the magnetic coupling in inductive components is only desirable to a limited extent. In transformers, for example, a certain degree of leakage inductance as current limitation in the event of a short circuit is generally desirable. For example, differential-mode interferences in current-compensated chokes are suppressed by predetermined leakage inductances. In current doubler circuits, for example, smoothing chokes are configured as coupled inductors with leakage path. It is hence common practice in many cases to adopt measures, when designing an inductive component, which reduce the magnetic coupling and increase the leakage inductance.

A simple option for increasing the leakage inductance is the reduction of the magnetic coupling between the windings by spacing the windings apart, and by interleaving them to a smallest possible extent. However, this measure helps to obtain only a very small and limited increase of the leakage inductance. To further increase the leakage inductance, moreover, discrete leakage paths of a material having a magnetic permeability <1 are introduced into a magnetic core between the windings. In many cases, air gaps are incorporated in the leakage path so as to prevent an excessive magnetic flow through the leakage path, so that the leakage inductance is effectively limited. In known E-core configurations the main and leakage inductances are adjusted, for example, by providing a winding around the outer legs, and by providing air gaps in the center leg and/or the outer legs. These known magnetic cores have the drawback, however, that they have poor mechanical properties due to the air gaps formed in the magnetic core, and are easily damaged when subjected to mechanical loads. Moreover, for adjusting the desired leakage inductance values, frequently large dimensions have to be chosen for corresponding magnetic cores, so that correspondingly produced inductive components are still in need for a very large installation space.

In other known inductive components, conventionally, leakage elements are arranged as separate core segments between the center leg and outer leg(s), wherein leakage inductances are determined by the air gaps formed between center legs, outer legs and leakage segments. In this case it has shown, however, that air gaps only have a poor homogeneous adjusting capacity, and correspondingly manufactured components go into saturation very early, with the leakage inductance slowly decreasing. This is not acceptable for a great number of applications. Due to the tolerances in the air gap, which are unavoidable in these magnetic cores, a series production is only difficult to control.

Proceeding from the conventional magnetic cores and inductive components as described above there is, therefore, a demand for a magnetic core and an inductive component in which the leakage inductance can be adjusted very accurately and reproducibly. At the same time, corresponding magnetic cores are suitable for series production.

SUMMARY OF THE INVENTION

According to aspects of the present invention, the a plate-shaped leakage structure as an insert in a magnetic core for an inductive component is provided, wherein the plate-shaped leakage structure is passed through along its thickness direction by at least one spacer having (as opposed to the rest of the material of the leakage structure) a very low magnetic permeability.

In a first aspect of the present invention, a plate-shaped leakage structure may be provided as an insert in a magnetic core for an inductive component. In embodiments herein, the plate-shaped leakage structure may comprise a first leakage structure portion and a second leakage structure portion, each formed of a first material, and a first spacer formed of a second material which, as opposed to the first material, may have a lower magnetic permeability. The first spacer may separate the first leakage structure portion from the second leakage structure portion, and may pass through the leakage structure along the thickness direction thereof. The plate-shaped leakage structure may provide for a leakage path that may be inserted into a magnetic core of an inductive element, allowing for a very exact and reproducible adjustment of leakage inductances without reducing mechanical and/or magnetic properties of a magnetic core to be produced. The plate-shaped leakage structure may be further easily adapted, even during subsequent production processes, allowing the adjustment of a desired leakage inductance value and/or desired geometrical dimensions of the leakage structure on the basis of a predetermined design.

In a second aspect of the present invention, a magnetic core may be provided. In embodiments herein, the magnetic core may comprise a first core section having a first core leg, and a second core section having a second core leg. The magnetic core may further comprise a plate-shaped leakage structure according to the first aspect. The plate-shaped leakage structure may be arranged between the first core section and the second core section, so that each core section rests on a bearing surface of the leakage structure. In a bearing surface of the plate-shaped leakage structure, the first core leg may cover a first surface section formed of an exposed first material. In the opposite bearing surface, the second core leg may cover a second surface section formed of an exposed first material.

Thus, very compact components may be provided, the leakage inductance of which may be constant to a great extent and may only decrease later.

In a third aspect of the present invention, an inductive component may be provided. In embodiments herein, the inductive component may comprise a magnetic core according to the second aspect, a first winding provided on the first core leg, and a second winding provided on the second core leg. The leakage structure may be arranged in the magnetic core between the first and the second winding. Thus, inductive components with an advantageous leakage path guidance may be provided.

BRIEF DESCRIPTION OF THE DRAWINGS

Additional features, advantageous embodiments and advantages of the present invention are described in the accompanying patent claims and may be understood from the detailed description of illustrative embodiments as given below with regard to the figures. In the figures:

DETAILED DESCRIPTION

Figure 1:
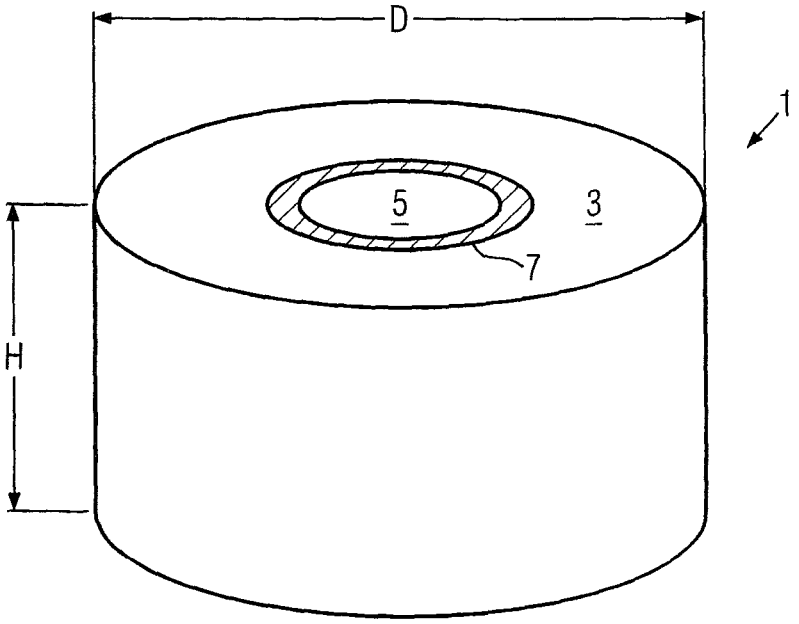
FIG. 1 shows a perspective view of a plate-shaped leakage structure according to an embodiment of the invention.

Described below are various illustrative embodiments of the present invention, wherein in the interest of clarity, not all features of an actual implementation are described. It will of course be appreciated that in the development of any such actual embodiment, numerous implementation-specific decisions must be made to achieve the specific goals of the developer, such as compliance with system-related and business-related constraints, which will vary from one implementation to another. Moreover, it will be appreciated that such a development might be complex and time-consuming, but would nevertheless be a routine undertaking for those of ordinary skills in the art having the benefit of this disclosure.

The present invention will now be described in greater detail with reference to the attached figures. Various structures, components and devices are schematically depicted in the drawings for purposes of explanation only and so as to not obscure the present disclosure with details which are well-known to those skilled in the art. Nevertheless, the attached drawings are included to describe and explain some illustrative examples of the present invention as will be described below in greater detail. The words and phrases used herein should be understood and interpreted to have a meaning consistent with the understanding of those words and phrases used by the person with skills in the relevant art. No special definition of a term or phrase, i.e., a definition that is different from the ordinary or customary meaning as understood by the skilled person, is intended to be implied by a consistent usage of the term or phrase herein. To the extent that a term or phrase is intended to have a special meaning, i.e., a meaning other than that understood by skilled artisans, such a special definition shall be expressively set forth in the specification in a definitional manner that directly and unequivocally provides the special definition for the term or phrase.

In accordance with some illustrative embodiments of the first aspect of the present invention as described in section "Summary of the Invention" above, the first spacer may have a hollow-cylindrical configuration, which makes the leakage structure advantageously insertable in magnetic cores with core legs, which cores having a round cross-section and/or a round overall configuration, e.g. pot cores and cup cores.

In some illustrative embodiments of the first aspect, the leakage structure may have a cylindrical configuration. The leakage structure may thus be particularly suitable as an insert in pot and cup cores.

In some illustrative embodiments of the first aspect, the leakage structure may further comprise a second spacer formed of a second material, and a third leakage structure portion formed of the first material. The second spacer may separate the third leakage structure portion from the second leakage structure portion and may pass through the leakage structure along the thickness direction thereof. Thus, an advantageous leakage structure may be created for use in magnetic cores that are formed of E- and/or C-cores.

In some illustrative embodiments of the first aspect, a spacing of the leakage structure portions may be smaller than a thickness of the leakage structure defined along the thickness direction thereof. The person skilled in the art will appreciate that a thickness of a plate-shaped body, respectively, the thickness direction thereof, may be generally understood as the dimension of the leakage structure transversely to the large-area surfaces thereof, as will be described below. A corresponding spacing may effectively limit the leakage inductance of the leakage structure.

In some illustrative embodiments of the first aspect, the first material may comprise a ferrite material, and the second material may comprise a ceramic material or plastic material. Respective leakage structures may have advantageous magnetic properties and may be, at the same time, easily produced.

In some illustrative embodiments of the first aspect, the spacers may be sintered into the leakage structure. Thus, a mechanically stable leakage structure with easily predeterminable mechanical and magnetic properties may be provided, which may be also easily adapted during subsequent production phases.

In accordance with some illustrative embodiments of the second aspect of the present disclosure as described in section "Summary of the Invention" above, the first core section may further comprise a third core leg which covers, beside the first core leg, a third surface section formed of an exposed first material. The third surface section may be separated from the first surface section by a surface section formed of an exposed second material. Consequently, a leakage path with a gap may be easily provided between the first and third core leg, as the first and third core leg may each rest on leakage sections which are spaced apart by the spacer. Hence, a leakage path guidance may be provided between two core legs.

In some illustrative embodiments of the second aspect, the second core section may further comprise a fourth core leg which covers, beside the second core leg, a fourth surface section formed of an exposed first material. The fourth surface section may be separated from the second surface section by a surface section formed of an exposed second material. Consequently, a leakage path with a gap may be easily provided between the second and fourth core leg, as the second and fourth core leg each may rest on leakage sections which are spaced apart by the spacer. Hence, an advantageous leakage path guidance may be provided between two core legs.

In some illustrative embodiments of the second aspect, the magnetic core may be configured as a pot core or cup core, and the plate-shaped diffuser is cylindrical. Thus, pot or cup cores with advantageous leakage paths may be provided.

In some illustrative embodiments of the second aspect, the magnetic core may have a double E-, double C- or E-C-core configuration, and the plate-shaped leakage structure may have two spacers. Thus, an advantageous leakage path guidance may be provided, wherein, at the same time, a great mechanical stability for a great number of core configurations may be provided.

In some illustrative embodiments of the second aspect, the leakage structure in the magnetic core may be arranged in an air gap formed by the first and second core leg. This may permit a further compact design.

In accordance with some illustrative embodiments of the third aspect of the present disclosure as described above in section "Summary of the Invention" above, an inductive component may be provided. In embodiments herein, the inductive component may comprise a magnetic core according to the second aspect, a first winding provided on the first core leg, and a second winding provided on the second core leg. The leakage structure may be arranged in the magnetic core between the first and the second winding. Thus, inductive components with an advantageous leakage path guidance may be provided.

In some illustrative embodiments of the third aspect, the inductive component may be configured as a smoothing choke. Thus, a smoothing choke with an advantageous leakage path guidance may be provided.

The person skilled in the art will appreciate that, in some aspects of the present disclosure, very compact components with very good leakage path guidance may be provided by means of a plate-shaped leakage structure, without the plate-shaped leakage structure having a negative effect on the mechanical stability. Accordingly provided components may be suitable for the series production of inductive components due to easily adjustable mechanical and magnetic properties, which, according to the present disclosure, may be subject to small production tolerances. It may thus be possible to produce chokes and transformers with a leakage path guidance that may be easily adjusted, the produced transformers and chokes involving only small production tolerances. At the same time, magnetic leakage properties may be adjusted easily and in flexible manner.

The person skilled in the art will appreciate that the expression "plate-shaped" may be understood as "similar to a plate", and that, thus, curvatures in surfaces and/or edges are not precluded. A "plate-shaped structure" is to be understood as a geometrical structure which has dimensions along three mutually perpendicular directions, one of the three dimensions being substantially smaller than the other two dimensions. For example, a plate-shaped structure may be understood as cuboid-shaped (similar to a cuboid), with one dimension being substantially smaller than the dimensions perpendicular thereto. The expression "substantially smaller" is to be generally understood as <1. For example, a ratio of a dimension 'a' to a dimension 'b', which is substantially smaller than the dimension 'a', may be smaller than 1, and in particular smaller than 0.5 or 0.25 or 0.1. In an illustrative example, a ratio of the substantially smaller dimension to the greater one from the two other dimensions may be, for example, smaller than 0.2. Below, the dimension that is substantially smaller than the two other dimensions will be referred to as "thickness", and the corresponding direction in which the dimension is defined will be referred to as "thickness direction". Equally, the longer dimension of the two other dimensions will be referred to as "length", and the direction in which the length is defined will be referred to as "length direction". The remaining dimension will be referred to as "width", and the corresponding direction in which the width is defined will be referred to as "width direction". In cases in which length and width are equal, both will be referred to as "radius", and the corresponding direction will be referred to as "radial direction". In addition or as an alternative to the above definition of "plate-shaped", the person skilled in the art will appreciate that a "plate-shaped structure" has two opposing lateral faces, and the rest of the lateral faces (in terms of the area measures) are substantially smaller than the opposite lateral faces.

Below, different illustrative embodiments of the invention will be described by means of FIGS. 1 and 2. Herein, plate-shaped leakage structures may be provided as inserts in magnetic cores of inductive components so as to adapt a leakage path guidance in the magnetic core, and obtain high leakage inductance values along with a small production tolerance.

FIG. 1 schematically shows a plate-shaped leakage structure according to an embodiment of the invention. The plate-shaped leakage structure 1 may be formed of an annular or hollow-cylindrical first leakage structure portion 3 and a cylindrical second leakage structure portion 5, with an annular or hollow-cylindrical spacer 7 being arranged between the first leakage structure portion 3 and the second leakage structure portion 5. The first leakage structure portion 3 and the second leakage structure portion 5 may be spaced apart by the spacer 7, so that there may not be direct contact between the two leakage structure portions 3 and 5. The plate-shaped leakage structure 1 illustrated in FIG. 1 may be cylindrical and may have a thickness measured along a thickness direction H that may be substantially smaller than a diameter D of the plate-shaped leakage structure 1. When used in magnetic cores, an upper surface (perpendicular to the thickness direction H in FIG. 1) of the cylindrically configured, plate-shaped leakage structure 1 may serve as a bearing surface for at least one leg of a core section of a magnetic core, as will be described in more detail below with reference to FIGS. 3*a* and 3*b*. Accordingly, a lower surface of the cylindrically configured, plate-shaped leakage structure 1 may serve as a bearing surface for at least one core leg of another core part in a magnetic core, as will be described in more detail below with reference to FIGS. 3*a* and 3*b*.

The embodiment shown in FIG. 1 may be used as an insert in a pot or cup core, where a center leg rests on the upper surface or the lower surface such that the second leakage structure portion 5 in the bearing surface is at least partially covered. In general, the illustrated plate-shaped leakage structure 1 may be inserted in magnetic cores having a center leg with a round cross-section, wherein the exposed surface section of the leakage structure portion 5 may serve as a bearing surface for a center leg.

The core portions 3 and 5 of the plate-shaped leakage structure 1 may be formed of a material which has a higher permeability than the material of the spacer 7. In other words, the spacer 7 may be formed of a material which has a lower magnetic permeability than the core portions 3 and 5. The core portions 3 and 5 are, for example, may be formed of ferromagnetic or ferrimagnetic material. According to an illustrative example herein, the core portions 3 and 5 may be formed of a ferrite material, e.g. by means of sintering. Alternatively, the leakage structure portions 3 and 5 may be formed of a superparamagnetic material. As opposed to this, the spacer 7 may be formed, for example, of a ceramic material or plastic material.

To produce the plate-shaped leakage structure 1, the leakage structure portions 3 and 5 may, in accordance with an exemplary embodiment, each be formed by sintering a ferrite material. In this case, it should be assured that the correspondingly formed second leakage structure portion 5 may be inserted into a recess which centrally passes through the first leakage structure portion 3. The recess passing there through may be subsequently introduced into the sintered leakage structure portion 3, or may be realized by a mold for forming annular sintered compacts. During the production of the plate-shaped leakage structure 1, a diameter of the second leakage structure portion 5 may be defined such that the second leakage structure portion 5 may be arranged in the first leakage structure portion 3 without any contact between the two leakage structure portions. The person skilled in the art will appreciate that a ring diameter for, respectively, the thickness of the spacer 7 may be defined by a distance between the first leakage structure portion 3 and the second leakage structure portion 5 in the recess, in particular by a diameter of the recess (along D in FIG. 1).

The spacer 7 may be formed in a subsequent process step, with a second material being introduced into an air gap formed between the first leakage structure portion 3 and the second leakage structure portion 5. For example, the second material may be filled into the air gap in a solid or liquid form. According to some illustrative embodiments, solid material, e.g. provided as a powder, may be liquefied and cured in the gap. The spacer 7 may be formed once the second material in the gap has cured. Alternatively, a prefabricated ring body may be installed as spacer 7, which requires a high precision for fabricating the ring body. In other alternative embodiments a cylindrical spacer may be formed in the recess passing through the leakage structure portion, e.g. a prefabricated cylindrical spacer is arranged in the recess, or is formed by filling in a second material. Subsequently, a recess passing through the spacer may be provided in the cylindrical spacer arranged in the recess and/or fixed in same, in which the first leakage structure portion 5 is arranged. It is to be noted that spacers 7, which may be formed subsequently by filling a second material into the annular air gap between the leakage structure portions 3, 5, may be formed in an easy and fast manner. Desired thicknesses of the spacer 7 may be easily adjusted by accordingly treating the recess in the leakage structure portion 3 and/or the circumferential surface of the leakage structure portion 5. Production tolerances may, accordingly, be very small, and leakage inductances may be adjusted with great accuracy.

Figure 2:
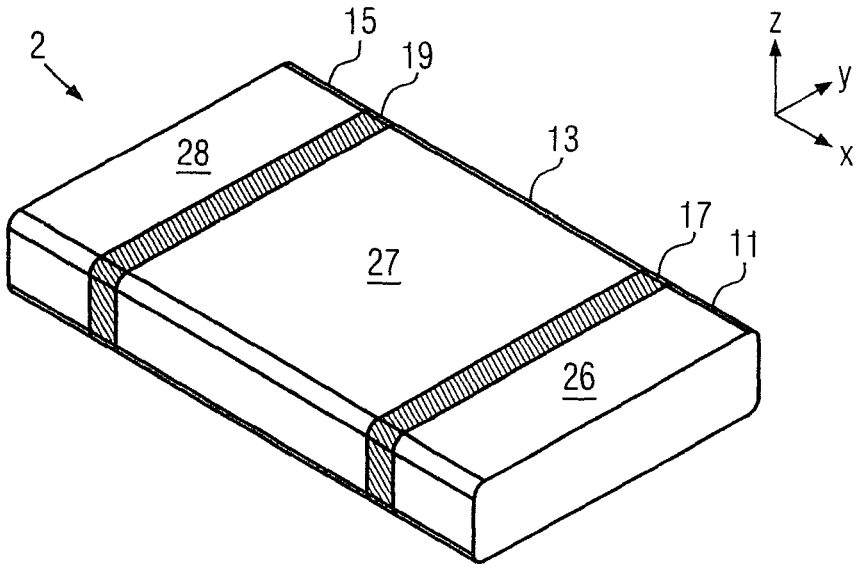
FIG. 2 shows a perspective view of a plate-shaped leakage structure according to another embodiment of the invention.

FIG. 2 shows an alternative embodiment of a plate-shaped leakage structure 2. According to the coordinate system perspectively shown in FIG. 2, a thickness direction of the leakage structure 2 is oriented along the z-axis, while a length direction runs along the x-axis. A width direction is oriented along the y-axis. The leakage structure 2 shown in FIG. 2 is cuboid-shaped with rounded longitudinal edges, so that damages to the leakage structure and/or damages of the inductive component to be formed in other production steps are avoided. The person skilled in the art will appreciated that this does not pose any limitation on the present disclosure. Furthermore, rounded width edges may be provided. Alternatively, curvatures and/or roundings may be waived.

The plate-shaped leakage structure 2 is formed of three leakage structure portions 11, 13 and 15. The leakage structure portions 11, 13, 15 may be formed of a first material. A spacer 17 may be arranged between the leakage structure portions 11 and 13. The leakage structure portions 13 and 15 may be spaced apart from one another by a spacer 19. The spacers 17 and 19 may be made of the second material. With regard to the first and second materials, reference may be made to the foregoing description. One surface section of the leakage structure portion 11 in an upper surface of FIG. 2 is designated with reference number 26. Corresponding surface sections of the leakage structure portions 13, 15 are provided with reference numbers 27, 28. The surface sections 26, 27, 28 may represent exposed surface sections of a first material in the upper surface of the plate-shaped leakage structure 2. The surface sections 26, 27, 28 may be separated or spaced apart from one another in the upper surface by exposed areas of the spacers 17, 19. The same may apply to the lower surface of the plate-shaped leakage structure 2 which may be arranged opposite the upper surface. The lower surface is not illustrated in the perspective view of FIG. 2. The upper and lower surface of the plate-shaped leakage structure 2 may each serve as a bearing surface for core legs, once the plate-shaped leakage structure 2 is inserted into a magnetic core, as will be described below with reference to FIGS. 3*a*, 3*b*.

The plate-shaped leakage structure 2 may be formed, for example, by alternate layers made of the first and second material and subsequent sintering, with the spacers 17 and 19 being sintered into the leakage structure 2. Alternatively, the leakage structure sections 11, 13 and 15 and the spacers 17 and 19 may be each produced separately and, subsequently, connected to one another, for example, in a gluing process or in an additional sintering process.

In the following process steps, the leakage structures 1 or 2 may be modified by subsequent adaptations such that a desired leakage inductance or saturation limit of the leakage inductance may be suitably adjusted. For example, by adapting the spacers in the plate-shaped leakage structure 1 or 2, a modification of the leakage inductance may be obtained. Increasing the saturation limit for the leakage inductance may be achieved by adapting the thickness of the plate-shaped leakage structure 1 or 2. Thus, specific magnetic properties of the plate-shaped leakage structure may also be adapted in subsequent processing steps, so that the plate-shaped leakage structures 1 and 2, as provided according to the present disclosure, may provide for leakage inductances, and saturation limits for leakage inductances, along with very small production tolerances. The person skilled in the art will appreciate that the leakage inductance and saturation limit may be adjusted by appropriately dimensioned leakage structure sections and/or spacers.

Figure 3A:
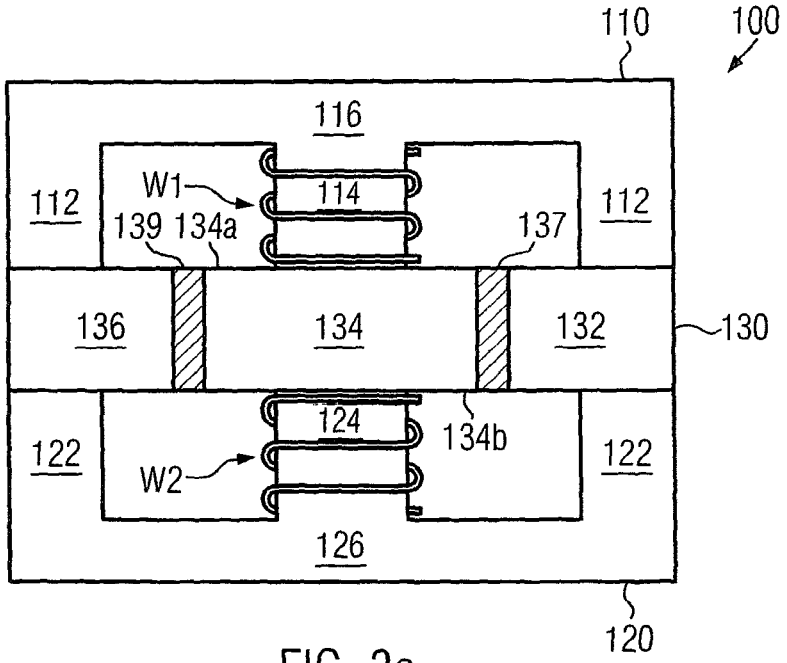
FIG. 3*a* shows a schematic sectional view of an inductive component according to an embodiment of the invention.

Below, magnetic cores and inductive components in accordance with illustrative embodiments of the invention will be described with reference to FIGS. 3*a* and 3*b*. FIG. 3*a* schematically shows, in a cross-sectional view, an inductive component including a magnetic core 100 according to one embodiment, and windings W1 and W2. The magnetic core 100 is formed of a first core section 110, a second core section 120 and a plate-shaped leakage structure 130. The first core section 110 includes outer legs 112 and a center leg 114, which are connected by a crossbar 116. The second core section 120 may include outer legs 122, a center leg 124, and a crossbar 126 connecting the outer legs 122 and the center leg 124 to one another.

In the cross-sectional view according to FIG. 3*a* the plate-shaped leakage structure 130 may comprise leakage structure portions 132, 134 and 136, as well as spacers 137 and 139. The person skilled in the art will appreciate that the plate-shaped leakage structure 130 may correspond to one of the plate-shaped leakage structures 1 and 2 that were described above with reference to FIGS. 1 and 2. In particular, the leakage structure 130 may have a configuration corresponding to the leakage structure 1, if the magnetic core 100 is designed according to a pot or cup core configuration (in this case, the magnetic core 100 and the leakage structure 130 may be rotationally symmetric relative to the cross-sectional view in FIG. 3*a*).

According to the illustration in FIG. 3*a*, the leakage structure 130 may be arranged between the core sections 110 and 120, so that the outer legs 112, 122 and the center legs 114, 124 on the bearing surfaces 134*a*, 134*b* may rest on, respectively, abut against the corresponding leakage structure portions 132, 134 and 136. In this arrangement, an air gap towards the leakage plate may be ground into the center leg of the two main cores. The two air gaps in the main core may adjust the main inductance of the magnetic core. The leakage inductance may be adjusted by the two gaps (spacers 137, 139) formed in the leakage structure 130. It is to be noted that the legs and the leakage structure may be glued to one another, so that a gluing agent may be provided between the legs and the bearing surface of the leakage structure. In particular, surface sections of the leakage structure sections 132, 134 and 136 may be covered, in the bearing surfaces 134*a*, 134*b*, by the outer legs 112, 122 and center legs 114, 124, the surface sections being formed by an exposed first material. In particular, exposed areas of the second material in the bearing surface, in particular the spacers 137, 139 may be exposed in the bearing surfaces 134*a*, 134*b*, may not be covered by the core legs 112, 122, 114, 124 of the core sections 110, 120. The person skilled in the art will appreciate that, with the core sections 110, 120 being in a surface contact, the spacers 137, 139 may be exposed in winding spaces formed in the magnetic core 100. Thus, gaps may be provided by the spacers 137, 139 in the leakage path, the leakage path being provided by means of the leakage structure 130 between the legs of the magnetic core 100. The magnetically active cross-section of each leg may thus not be influenced by the leakage structure 130. Alternatively, a surface section covered by the center legs 114, 124 in at least one bearing surface may be smaller than the magnetically active cross-section of at least one center leg 114, 124.

The windings W1 and W2 are provided on the center legs 114, 124, whereby the windings W1 and W2 may be separated by the interposed leakage structure 130. The windings W1 and W2, whose coupling in the inductive component is to be reduced, may be provided on both sides of the leakage structure 130, as illustrated, so that the plate-shaped leakage structure spaces the windings W1 and W2 apart from one another. Additionally or alternatively, windings may be provided on the outer legs.

Figure 3B:
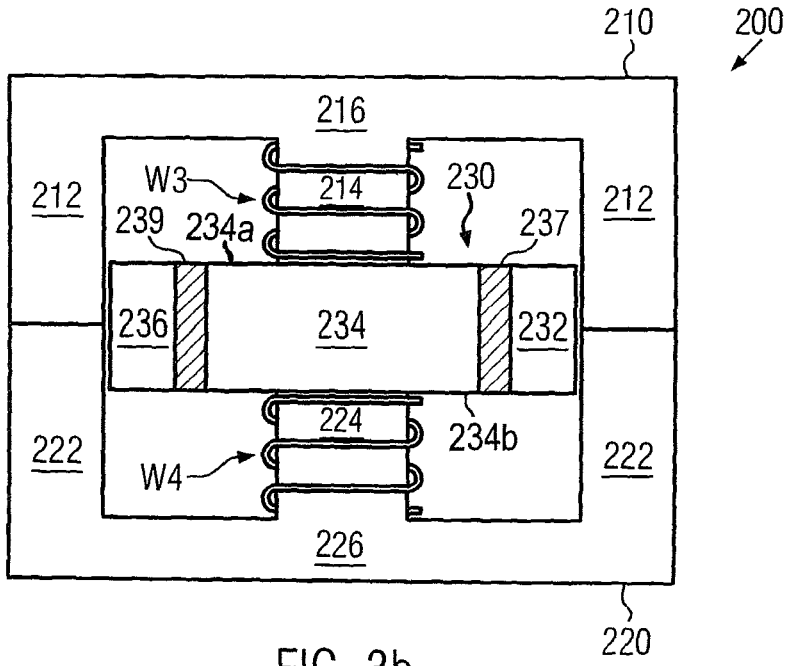
FIG. 3*b* shows a schematic sectional view of an inductive component according to another embodiment of the invention.

FIG. 3*b* schematically illustrates, in a cross-sectional view, an alternative embodiment of an inductive component with a leakage structure insert, wherein a leakage structure 230 is inserted in a magnetic core 200 for guiding the leakage path. The magnetic core 200 may be formed of a first core section 210, a second core section 220 and a plate-shaped leakage structure 230. The first core section 210 may comprise outer legs 212 and one center leg 214, which are connected by a crossbar 216. The second core section 220 may comprise outer legs 222, one center leg 224 and a crossbar 226 connecting the outer legs 222 and the center leg 224.

In the cross-sectional view according to FIG. 3*b*, the plate-shaped leakage structure 230 may include leakage structure portions 232, 234 and 236, as well as spacers 237 and 239. The person skilled in the art will appreciate that the plate-shaped leakage structure 230 may correspond to one of the plate-shaped leakage structures 1 and 2 that were described above with reference to FIGS. 1 and 2. In particular, the leakage structure 230 may have a configuration corresponding to leakage structure 1, if the magnetic core 200 is designed according to a pot or cup core configuration (in this case, the magnetic core 200 and the leakage structure 230 may be rotationally symmetric relative to the cross-sectional view in FIG. 3*b*).

According to the illustration in FIG. 3*b* the leakage structure 230 may be arranged between the core sections 210 and 220, so that the center legs 214, 224 in the bearing surfaces 234*a*, 234*b* may rest on, respectively, abut against leakage structure section 234. In this arrangement, an air gap towards the leakage plate may be ground into the center leg of the two main cores. The two air gaps in the main core may adjust the main inductance of the magnetic core. The leakage inductance may be adjusted by the two gaps (spacers 237, 239) formed in the leakage structure 230. The person skilled in the art will appreciate that the center leg 214, 224 and the leakage structure 230 may be glued to one another, so that a gluing agent is provided between the center legs 214, 224 and the leakage structure portion 234. In particular, surface sections of the leakage structure portion 234 may be covered, in the bearing surfaces, by the center legs 214, 224, the surface sections being formed by an exposed first material. In particular, exposed areas of the second material in the bearing surface, in particular the spacers 237, 239 exposed in the bearing surfaces, may remain uncovered by the center legs 214, 224. This means, with the core sections 210, 220 being in a surface contact in the bearing surfaces, the spacers 237, 239 may be exposed in winding spaces formed in the magnetic core 200. Thus, gaps may be provided by the spacers 237, 239 in the leakage path, the leakage path being provided by means of the leakage structure 230 between the center legs 214, 224 of the magnetic core 200. The magnetically active cross-section of each center leg 214, 224 may thus not be influenced by the leakage structure 230. Alternatively, a surface section covered by the center legs 214, 224 in at least one bearing surface may be smaller than the magnetically active cross-section of at least one center leg 214, 224.

The inductive component illustrated in FIG. 3*b* may further include windings W3 and W4 formed on the center legs 214, 224, which are separated by the interposed leakage structure 230. The windings W3 and W4, whose coupling in the inductive component is to be reduced, may be provided on both sides of the leakage structure 230, as illustrated, so that the plate-shaped leakage structure 230 may space the windings W3 and W4 apart from one another. Additionally or alternatively, windings may be provided on the outer legs.

In the inductive component illustrated in FIG. 3*b*, the leakage structure 230 may be fitted into an air gap which is defined between the center legs 214, 224 of the assembled core sections 210, 220. The outer legs 212, 222 of the assembled core sections 210, 220 may rest on one another. In this case, it may be further possible to adjust the leakage inductance by adjusting an additional air gap between the leakage structure 230 and the outer legs 212, 222 of the magnetic core 200. Additional adjustment possibilities may be realized by providing a material having a low magnetic permeability between the leakage structure 230 and the outer legs 212, 222 of the magnetic core 200, by which a very compact and mechanically stable configuration of the inductive component illustrated in FIG. 3*b* is achieved.

The person skilled in the art will appreciate that, if a modification of the leakage inductance in inductive components is desired, this may be easily accomplished by appropriately adapting the inserted leakage structures 130, 230. Moreover, the inductive components according to the present disclosure, as illustrated in FIGS. 3*a* and 3*b*, may be very compact, yet having a great mechanical stability. Due to the leakage path guidance as provided in the leakage structure 130, 230, an advantageous saturation behavior of the leakage inductance may be provided. Accordingly, the saturation curve may be extremely constant up to the point of saturation, and may then drop much later. The illustrated inductive components may be optimally suited for series productions due to the small production tolerances. For example, transformers and chokes may be provided with advantageous leakage inductance values. In a special illustrative example, a smoothing choke may be provided.

In the above description, reference is made to a first material and a second material. The first material may have a higher magnetic permeability than the second material. The person skilled in the art will appreciate that this does not pose any limitation on the present disclosure, and more than a first material and/or more than a second material having according magnetic properties may be provided.

With reference to FIG. 2, a plate-shaped leakage structure is described, which may be formed of three leakage structure portions and two spacers. The person skilled in the art will appreciate that this does not pose any limitation on the present disclosure, and more than three leakage structure sections may be provided instead, a spacer being arranged between each two leakage structure sections.

With reference to FIG. 1, a hollow-cylindrical, respectively, annular first leakage structure section is described. It will be appreciated that this does not limit the invention, but a cuboid-shaped leakage structure section, optionally with rounded surfaces and/or edges, may be provided, in which a recess passing through the leakage structure section and including an annular spacer, and a cylindrical second leakage structure section therein, is provided.

Summarizing, the present invention provides, in various aspects, a plate-shaped leakage structure as an insert in a magnetic core of an inductive component, a magnetic core having a plate-shaped leakage structure, and an inductive component. A plate-shaped leakage structure may, in this case, be provided as an insert in a magnetic core, which leakage structure being passed through, along the thickness direction thereof, by at least one spacer having a very low magnetic permeability (as opposed to the rest of the material of the leakage structure). In a magnetic core according to an aspect of the present disclosure, core legs may be arranged above opposite bearing surfaces of the plate-shaped leakage structure, the plate-shaped leakage structure providing a leakage path between the core legs. In a special illustrative example herein, the plate-shaped leakage structure may be a leakage plate with at least one integral gap passing through the leakage plate along the thickness direction thereof and being formed of a material of a low magnetic permeability. The gap may further pass through the leakage plate in the thickness direction thereof, and may be formed as a gap along the longitudinal direction.

The particular embodiments disclosed above are illustrative only, as the invention may be modified in practice and may be practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A plate-shaped leakage structure as an insert in a magnetic core having a magnetic field direction for an inductive component, the plate-shaped leakage structure having a length direction, a width direction and a thickness direction representing mutually perpendicular directions, wherein the length directions indicates a direction along which the dimension of the plate-shaped leakage structure is longer than dimension along the width and thickness directions, wherein the plate-shaped leakage structure comprises:

a first leakage structure portion, a second leakage structure portion, and a third leakage structure portion arranged along the length direction such that the first to third leakage structure portions combine to form a main plane, the main plane being normal to the thickness direction, wherein each of the first to third leakage structure portions is formed of a first material which comprises a ferrite material;

a first spacer formed of a second material which, as opposed to the first material, has a lower magnetic permeability, wherein the first spacer passes through the plate-shaped leakage structure along the thickness direction and the width direction, thereby separating the first leakage structure portion from the second leakage structure portion along the length direction, and a second spacer formed of the second material, wherein the second spacer passes through the plate-shaped leakage structure along the thickness direction and the width direction, thereby separating the second leakage structure portion from the third leakage structure portion along the length direction, wherein each of the first and second spacers are sintered into the plate-shaped leakage structure and separate the leakage structure portions by a distance smaller than a thickness of the plate-shaped leakage structure measured along the thickness direction thereof, and wherein said first, second, and third leakage structure portions each have a bearing surface formed on the main plane with each of the bearing surfaces covered by a magnetic core section and positioned within the magnetic core of the inductive component with the magnetic field direction being perpendicular to the bearing surfaces and the main plane of the plate-shaped leakage structure.

2. The plate-shaped leakage structure according to claim 1, wherein the second material comprises a ceramic material.

3. A plate-shaped leakage structure as an insert in a magnetic core used in forming an inductive component, the magnetic core having a magnetic field direction comprising:

a first leakage structure portion, a second leakage structure portion, and a third leakage structure portion combined to form a main plane, each of said first, second, and third leakage structure portions being formed of a first material;

a first spacer formed of a second material having a lower magnetic permeability than the first material, wherein said first spacer is sintered to and separates the first leakage structure portion from the second leakage structure portion and passes through the plate-shaped leakage structure along a thickness direction perpendicular to the main plane of the plate-shaped leakage structure;

a second spacer formed of the second material having a lower magnetic permeability than the first material, wherein said second spacer is sintered to and separates the third leakage structure portion from the second leakage structure portion and passes through the plate-shaped leakage structure along the thickness direction perpendicular to the main plane of the plate-shaped leakage structure;

wherein each of the first and second spacers separate said first, second, and third leakage structure portions by a distance smaller than a thickness of the plate-shaped leakage structure measured along the thickness direction perpendicular to the main plane of the plate-shaped leakage structure; and wherein said first, second, and third leakage structure portions each have a bearing surface formed on the main plane with each of the bearing surfaces covered by a magnetic core section and positioned within the magnetic core of the inductive component with the magnetic field direction being perpendicular to the bearing surfaces and the main plane of the plate-shaped leakage structure, whereby the plate-shaped leakage structure and said first and second spacers are capable of adjusting a leakage inductance of the inductive component.

* * * * *